United States Patent [19]

Goens et al.

[11] 3,973,949

[45] Aug. 10, 1976

[54] ZINC RECOVERY BY CHLORINATION LEACH

[75] Inventors: Duane N. Goens; James E. Reynolds, both of Golden, Colo.

[73] Assignee: Cyprus Metallurgical Processes Corporation, Los Angeles, Calif.

[22] Filed: Feb. 13, 1975

[21] Appl. No.: 549,728

[52] U.S. Cl. ..... 75/112; 75/114; 75/120; 204/60; 204/128; 423/92; 423/100; 423/105; 423/109; 423/419

[51] Int. Cl.[2] ..... C22B 3/00; C01G 9/00

[58] Field of Search ..... 423/109, 99, 150, 139, 423/105, 491, 100, 419, 92; 204/128, 39; 75/101 BE, 120, 112, 114

[56] References Cited

UNITED STATES PATENTS

| | | | |
|---|---|---|---|
| 1,736,659 | 11/1929 | Mitchell | 423/36 |
| 2,045,092 | 6/1936 | Mitchell | 423/109 |
| 2,094,277 | 9/1937 | Mitchell | 423/109 |
| 2,187,750 | 1/1940 | Marvin | 75/101 R |
| 3,206,276 | 9/1965 | Burwell et al. | 23/312 ME |
| 3,206,277 | 9/1965 | Burwell et al. | 23/312 ME |
| 3,251,646 | 5/1966 | Alon et al. | 75/101 BE |
| 3,649,220 | 3/1972 | Powell et al. | 423/99 |

FOREIGN PATENTS OR APPLICATIONS

| | | | |
|---|---|---|---|
| 44-4647 | 1969 | Japan | 423/109 |

*Primary Examiner*—Oscar R. Vertiz
*Assistant Examiner*—Wayne A. Langel
*Attorney, Agent, or Firm*—Sheridan, Ross & Fields

[57] ABSTRACT

A pollution-free process for the recovery of high purity zinc from zinc containing material including sulfide ores which provides for maximum conservation and re-use of reagents, the process consisting of chlorinating the materials either with ferric chloride or chlorine gas followed by selective removal of metals other than zinc by standard procedures, such as, lead chloride crystallization, cementation, etc. to produce a solution containing essentially only zinc chloride and ferrous chloride. To enhance the purity of the zinc end product zinc chloride is separated from the ferrous chloride solution with a zinc selective extraction agent from which the zinc chloride is stripped with sodium chloride solution in a sodium chloride stripping circuit followed by precipitation of zinc as the carbonate. The sodium chloride formed in precipitating zinc carbonate with sodium carbonate goes to an electrolytic cell to produce chlorine and sodium hydroxide by electrolysis which latter is carbonated to sodium carbonate for circulation to the zinc carbonate precipitation. The sodium chloride stripping circuit includes the electrolytic cell where excess chlorine is removed from the stripping solution. The ferrous chloride raffinate from the zinc chloride extraction step is sent to a chlorination and hydrolysis step where ferric chloride leaching agent is regenerated and iron removed. Chloride from the electrolysis step is used for the chlorination step. The process results in very little loss of reagents from the system.

27 Claims, 3 Drawing Figures

ZINC RECOVERY BY CHLORINATION LEACH

ZINC RECOVERY BY CHLORINATION LEACH

BACKGROUND OF THE INVENTION

1. Field of the Invention

The invention lies in the field of recovering metals from their ores and other metal containing material by first chlorinating the metals followed by final recovery of the metals from their chlorides.

2. Description of the Prior Art

Competition, the increasing necessity of using lower and lower grade ores, the requirement that metal recovery processes be essentially non-polluting, and other factors have created a demand for a reduction of the costs for recovering metals from their ores and other materials for the pollution-free processes. Conservation and re-use of reagents appears to be the most feasible area for reduction of costs.

U.S. Pat. No. 1,736,659, Mitchell, discloses a process for the recovery of metals from their sulfide ores in which the metals are first chlorinated and then selectively separated. In this process iron is separated from the desired zinc chloride by precipitation of the iron before the zinc recovery step. The disadvantage of this procedure is that substantial zinc losses will occur in the voluminous iron hydroxide precipitate. Further, Mitchell precipitates the zinc product from the original dissolution solution after various attempts at removing impurities from it. Such a system inevitably results in an impure zinc product. The present invention uses a zinc selective extractant by which the zinc is effectively cleanly separated from the dissolving solution without the necessity of prior precipitation of all other impurities. The present process thereby permits a higher recovery of higher purity zinc.

In the Mitchell process an electrolytic cell is used to generate from sodium chloride formed in the zinc precipitation step the base required to precipitate zinc. In the present process the electrolytic cell is used not only for this purpose but primarily to regenerate the sodium chloride stripping agent used to remove the zinc from the extractant so that additional reagent need not be added for stripping. Using sodium chloride regenerated in the process as the stripping agent and including the electrolytic cell in the stripping circuit to remove excess chlorine ions picked up by the stripping solution in stripping obviates the necessity for an additional stripping reagent and an external procedure for removing excess chlorine ions.

SUMMARY OF THE INVENTION

A process is disclosed for recovering zinc from materials in which it is contained in which zinc and other metals in the material are first chlorinated to form a leach solution of chlorides of the metals followed by recovery of lead chloride by crystallization, removal of trace metals such as copper, silver, arsenic, lead and bismuth, etc., by cementation, separation of the zinc chloride from the remaining ferrous chloride solution by tertiary amine or tributylphosphate extraction agents for the zinc chloride with the ferrous chloride being sent to an iron hydrolysis and chlorination step, the zinc chloride being stripped from the agent with an electrotyzed sodium chloride solution followed by the precipitation of zinc from the strip solution with sodium carbonate with the regeneration of sodium chloride which goes to a sodium chloride electrolytic cell for formation of chlorine and sodium hydroxide, the cell also regenerating the stripping agent by removing chlorine gas at the anode which is sent with the rest of the chlorine to the iron chlorination step, sodium hydroxide formed in the electrolysis step being converted to sodium carbonate which is sent to the zinc carbonate precipitation step. Part of the sodium hydroxide may be included in the stripping agent when the tertiary amine is used as an extractant to control the acidity of the amine extractant. Zinc is recovered from the precipitated zinc carbonate by calcination and the carbon dioxide formed is sent to the sodium hydroxide carbonation step. Chlorine from the electrolysis step is sent to the iron chlorination step in one modification of the invention while in an alternative modification in which chlorine gas is used for the chlorination step it is sent to the gas chlorination step.

An alternative procedure is the precipitation of zinc, as zinc hydroxide with sodium hydroxide from the cell thus eliminating the step of carbonating sodium hydroxide when the zinc is precipitated as the carbonate.

DESCRIPTION OF THE PREFERRED EMBODIMENT

Figure 1:
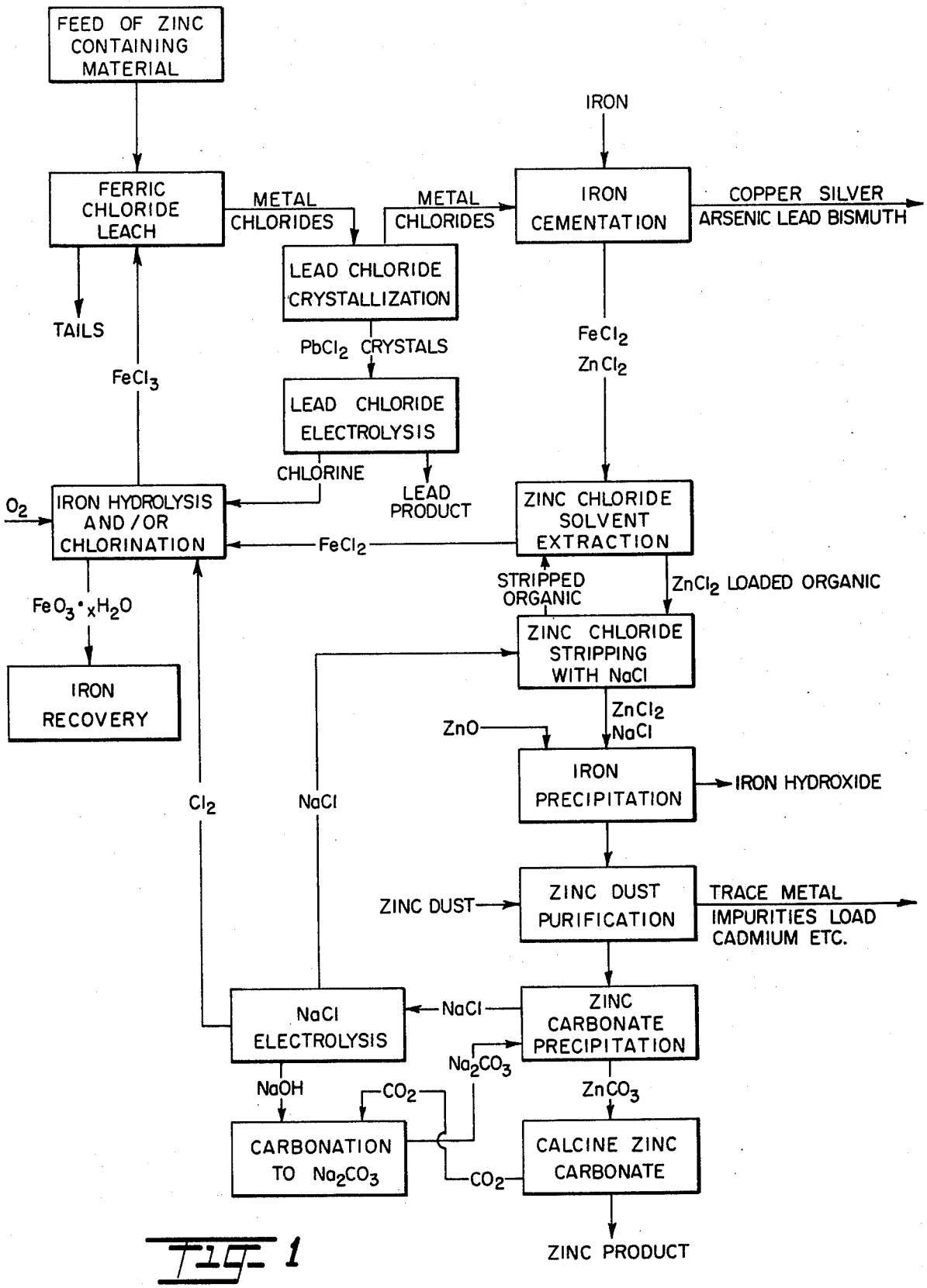
FIG. 1 is a flow diagram of the process of the invention.

Reference will now be made to the flow diagram of FIG. 1 for a description of the process of the invention. The flow diagram and its description does not include the conventional equipment used in the various steps, such as, thickeners, filters, centrifuges, dechlorinaters, evaporaters, etc.

The feed can be any material which contains zinc, usually, a chlorinatable ore of zinc. The process can be used to recover zinc from scrap alloys of zinc. The invention is illustrated by its application to the recovery of zinc and other metals from a sulfide ore; however, it is by no means limited to this application as zinc can be recovered from various zinc containing starting materials. If the zinc is being recovered from an ore the latter will first be ground and concentrated. For this purpose of illustrating the operation of the invention as depicted in the flow diagram of FIG. 1 an example was selected in which the feed material was a concentrate of zinc ore which contained 24.4% zinc, 15.6% iron, 15.8% lead, 27.6% sulfur and 4.1 ounces of silver per ton, the example being described below.

One and two-stage leaches were performed by contacting varying amounts of the concentrate with 500 cc of ferric chloride lixiviant in conventional 1000 cc 3-neck flasks provided with paddle stirrers, reflexing condensers and heating mantles.

The lixiviant in all tests contained approximately 100 g/l ferric iron and 30 g/l ferrous iron. In the 1-stage leaches the amount of concentrate was varied so that 1, 50 and 200 per cent of stiochiometric ferric iron was available to react with the lead and zinc sulfides. It was found that ferrous chloride serves the function of holding the lead chloride in solution. The preferred concentration of ferrous chloride in the leach solution for holding all of the lead chloride in solution is in excess of about one molar. The leaches were performed at 100°C for one half to four hours. The leaching resulted in conversion to the chlorides of 97.6% zinc, over 95% lead, 35–50% iron and 96% silver with the sulfur being converted to elemental sulfur which was removed in the tails.

An alternative procedure is the use of chlorine gas either alone or with some ferric chloride for the chlorination step. Following chlorination with the gas the remainder of the flowsheet is carried out. Chlorine gas from the anode is recycled to the gas chlorination step.

The next step in the flow diagram, after required filtration, is the recovery of lead chloride from the leach solution by crystallization. Lead chloride crystals were recovered from the 2-stage leach filtrate by cooling from the initial 80°C to about 10°C. The crystals contained 73.9% lead. Lead is recovered from the crystallized lead chloride by fused salt electrolysis to produce metallic lead and chlorine which latter is cycled to the iron chlorination step.

The filtrate from the lead chloride crystallization contained as impurities 1.09 g/l copper, 0.018 g/l antimony, 0.038 g/l arsenic and 1.52 g/l lead as well as the original silver content. These metal impurities were removed by conventional cementation procedures with metallic iron. The removal efficiency of the metal impurities by cementation was found to be 99.8% copper, 85% arsenic, 33% antimony and 9% lead. The treatment with metallic iron serves the additional purpose of reducing all of the iron in the solution to ferrous iron. Other metals than iron may be used for cementation of the trace metals and other means for removing them may be used. Other means for reducing the iron to the ferrous state or insuring that it is in the ferrous state and may be used. It is important that the solution which is contacted with the extraction agent later to remove zinc chloride be substantially free of ferric iron as the agents extract ferric iron which would contaminate the zinc product. One way to insure there is substantially no ferric iron in the metal depleted leach solution contacted by the zinc chloride selective extraction agent is to reduce the ferric iron with metallic iron or other reducing agent. However, the ferric chloride leach of the starting material can be readily conducted so that substantially no ferric iron exists in it.

The filtrate from the cementation step contained essentially ferrous chloride and zinc chloride with a minor amount of the metal impurities mentioned above. The next step is the separation of zinc chloride from the ferrous chloride with an extractant which is selective for the zinc chloride. Successful extractants for zinc chloride were found to be tributylphosphate and a tertiary amine (Tri$C_8$–$C_1$ amine) sold under the tradename "Agoden 364". Other tertiary amines can be used as extractants, such as, tri-laurylamine, tri-isooctylamine and tridecly amine. Other alkyl phosphates can be used, such as, the lower trialkylphosphates, including tripropylphosphate, dibutylphosphate and trioctylphosphate. By reference herein to zinc chloride in connection with loading and stripping from the agent is meant either molecular zinc chloride or an anionic zinc complex. The zinc complex as well as molecular zinc chloride can be stripped from the loaded extractant with water or sodium chloride solution. Conventional countercurrent extraction procedures were used.

Figure 2:
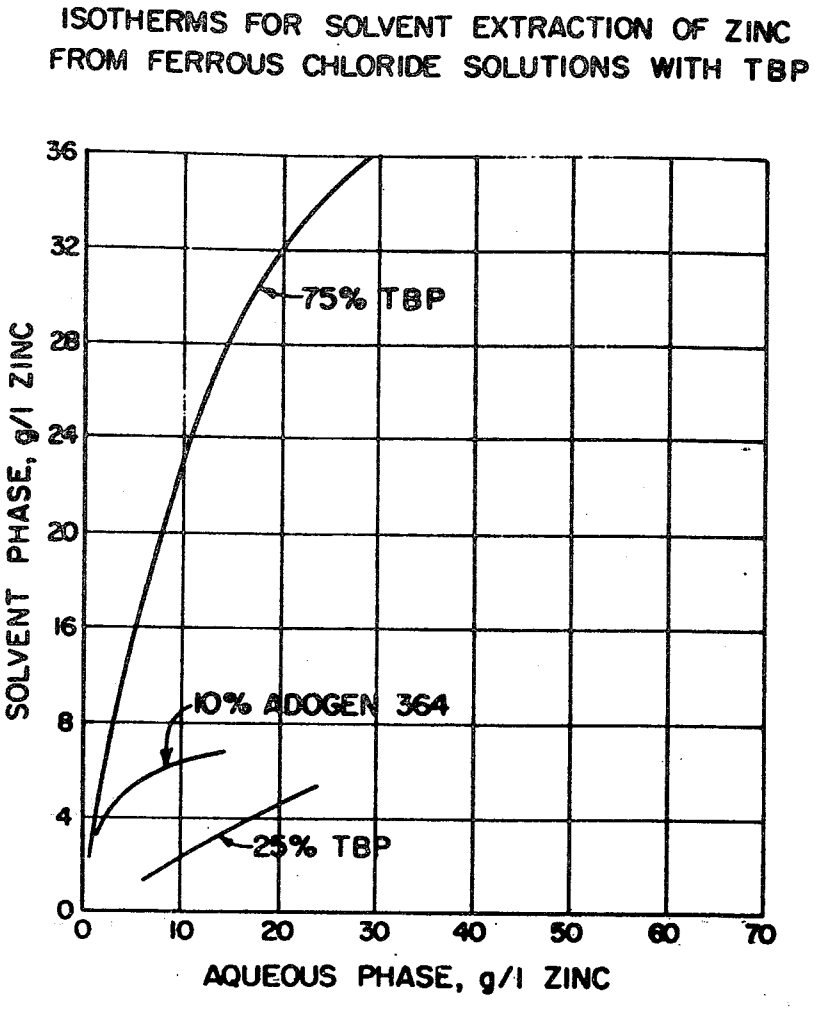
FIG. 2 is a graph of a loading curve of zinc chloride on a tributylphosphate extractant.

Extraction isotherms were made for various extraction systems, FIG. 2 being a graph of an isotherm for two tributylphosphate systems and one Adogen 364 system. The use of an extractant containing 75% by volume of tributylphosphate to the organic solvent gives the best results. The organic solvent used was kerosene; however, other conventional organic solvents may be used as solvents for the extraction agents. A preferred range is from about 25 to 85 volume per cent of tributylphosphate to the organic. The isotherm shows that solvent loadings in excess of 30 l/g zinc were found to be possible and nearly complete extraction of the zinc can be achieved by using a number of extraction stages.

Figure 3:
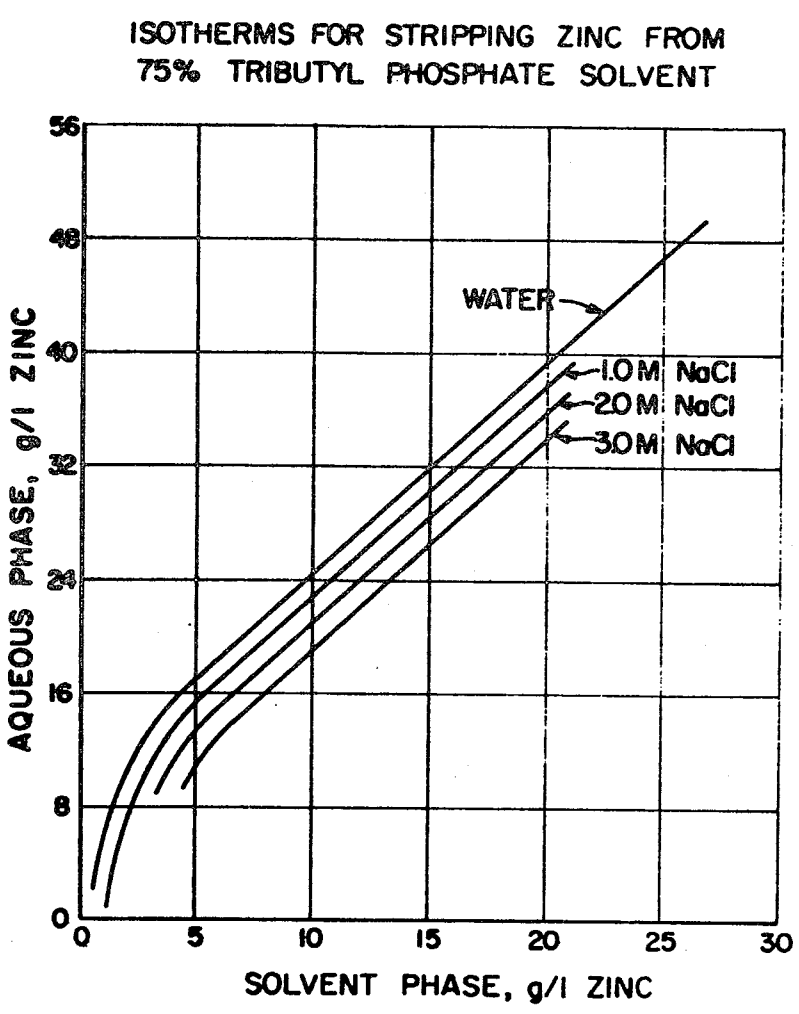
FIG. 3 is a graph of a stripping curve showing the effectiveness of stripping zinc chloride from a tributylphosphate extractant.

Zinc chloride was stripped from the loaded tributylphosphate and tertiary amine extractants with sodium chloride brine solution which is generated in the electrolytic cell as discussed hereinafter. Conventional stripping techniques were used. Other alkali metal chlorides can be used as stripping agents, such as, potassium chloride, by adjusting the system accordingly. FIG. 3 is a comparative stripping isotherm made from results obtained by stripping zinc from 75% tributylphosphate solvent with various concentrations of sodium chloride solution and water. As the isotherm shows, strip solutions containing 30 g/l of zinc were obtained using 2–3 molar sodium chloride solution for stripping.

The ferric iron that is entrained or otherwise extracted with the solvent will strip and contaminate the zinc solution. Accordingly, it is important to conduct the leaching so that substantially all of the iron is in the ferrous state or if this is not done to reduce as much iron as possible to the ferrous state and remove any remaining ferric iron as well as any bismuth, silver or cadmium before the loading step. The extractants do ont appreciably load ferrous iron. Any iron that is entrained in the stripping solution can be oxidized with chlorine and will precipitate with ferric hydroxide upon raising the pH to 3–4 with sodium carbonate. Only minute amounts of antimony, arsenic and lead will extract.

It was found that the teritary amines were effective as loading agents and can be stripped of zinc chloride with the sodium chloride strip solution coming from the electrolytic cell. When the amines are used as extractants the flow diagram is altered to use some of the sodium hydroxide from the cell to control the acidity of the amines for providing the best stripping efficiency.

As seen from the flow diagram, the ferrous chloride from which the zinc chloride was separated with the extraction agent is sent to iron hydrolysis and chlorination. By hydrolyzing part of the raffinate from the solvent extraction step exchange iron oxide is formed from the iron added for cementation and can be removed from this system. The remainder of the raffinate is chlorinated with chlorine from the electrolysis cell discussed below to ferric chloride which is returned to the leaching step. This permits use of the iron originally in the starting material as ferric chloride.

The solution from stripping contains essentially zinc chloride and sodium chloride. After further removal of iron by precipitation as ferrous hydroxide and cementing out trace impurities, such as, minute amounts of lead, cadmium etc. by zinc cementation with zinc dust the zinc chloride is sent to a zinc carbonate precipitation step where zinc is precipitated with sodium carbonate formed by carbonating sodium hydroxide produced in the electrolytic cell. After filtration zinc carbonate is calcined and otherwise treated to produce a high purity zinc product, some of which can be recycled to the zinc dust cementation step. As stated previously, an alternative procedure for the final recovery of zinc is to precipitate it as zinc hydroxide with sodium hydroxide from the cell and avoid the sodium hydroxide carbonation step.

The sodium chloride formed in the precipitation of zinc and that coming from the stripping step goes to the electrolytic cell where some of it is electrolyzed to produce chlorine at the anode and sodium hydroxide while some of it has its chlorine content reduced and then is recycled to the stripping step. The chlorine formed at the anode is sent to the iron chlorination step for chlorinating ferrous chloride to ferric chloride.

The cell used is commonly known as a chlorine-alkali cell or "Chloro-Alkali" cell and is of the type used for the commerical production of chlorine from sodium chloride. An anion ion exchange diaphragm which prevents the mixing of sodium chloride and sodium hydroxide in the cell is used. When sodium chloride is used to strip zinc chloride from the agents it was found that it picks up chlorine ion in increasing concentrations as it is recycled. Unless chlorine ion is continuously removed during recycling its concentration increases to the point were the solution does not effectively strip zinc chloride. Cycling the sodium chloride stripping solution through the cell where chlorine is continuously removed solves the problem.

Analyses showed that the process described is effective to recover 98% or more of the zinc contained in the starting materials as a high purity product.

The significant advantages of the invention as respects conservation of reagents are apparent from the above description and the accompanying flow diagram. First of all, all of the chlorine introduced into the system either by ferric chloride chlorination or gas chlorination is conserved and reused. None of it is eliminated from the system by the removal of any of the metal impurities. The chlorine in the lead chloride is recovered in the lead chlorine fused bath electrolysis and cycled to the iron chlorination step to regenerate ferric chloride. The chlorine in the metal chloride impurities is converted to ferrous chloride in the iron cementation step. The chlorine in the zinc chloride combines with sodium in the zinc carbonate precipitate to form sodium chloride which goes to electrolysis where the chlorine given off at the anode is used in the wet or dry chlorination of the metals in the starting material.

The ferrous chloride after the extraction step, containing most of the iron which was in the ore and the ferric chloride leaching agent, is sent to the iron chlorination and hydrolysis step for conversion to ferric chloride for re-use in the ferric chloride leach. The iron used for cementation is removed by hydrolysis. The result is that very little of the iron in the original ferric chloride leaching agent and the starting material is lost from the system.

Use of sodium chloride as a stripping agent is a distinctive advantage as the cell can be used to continuously reduce its chlorine content so that it does not become overloaded with chlorine in the stripping circuit. Production of sodium chloride in the zinc carbonate precipitation step provides a brine electrolyte for the electrolytic cell. Some of the zinc product can be reused in the zinc dust purification step and some of the carbon dioxide formed in the zinc calcination step can be used in the carbonation of sodium hydroxide to sodium carbonate.

The overall result of the process is that there is a maximum conservation and reuse of reagents wth very little addition of reagents required after startup.

What is claimed is:

1. In the process for treatment of materials containing zinc and other metals including lead, copper, silver, iron and trace metals in which the zinc and other metals are first converted to chlorides including ferric chloride either by wet chlorination with ferric chloride leaching or dry chlorination followed by separation of lead from the resulting leach solution by crystallization of lead chloride and further separation of copper, silver, and trace metals, reducing substantially all of the ferric iron in the leach solution to ferrous iron, ultimately precipitating zinc as zinc carbonate with an alkali metal carbonate and electrolyzing the alkali metal chloride formed by the zinc carbonate precipitation in an electrolytic cell to produce chlorine gas which is cycled to the chlorination step and alkali metal hydroxide which is converted to alkali metal carbonate for the zinc carbonate precipitation step, the improvement which comprises: separating the zinc chloride from the ferrous chloride in the metal depleted leach solution with an extraction agent selective for zinc chloride dissolved in an immiscible organic solvent, stripping the zinc chloride from the extraction agent prior to the zinc carbonate precipitation step with an alkali metal chloride stripping solution from the electrolytic cell through which the alkali metal chloride from the zinc carbonate precipitation step is continuously cycled for removal from it of excess chlorine ion picked up in the stripping.

2. The process of claim 1 in which the extraction agent is a member selected from the group consisting of lower alkyl phosphates and teritary amines.

3. The process of claim 2 in which the concentration of the extraction agent is about 20–85% by volume in the organic solvent.

4. The process of claim 3 in which the concentration of the extraction agent is about 75% by volume of the organic solvent.

5. The process of claim 2 in which the alkali metal compounds are sodium compounds.

6. The process of claim 2 in which the amine extraction agent is used at a basic pH.

7. The process of claim 2 in which the ferric chloride leaching step is conducted so that substantially all of the iron in the leach solution is in the ferrous state.

8. The process of claim 1 in which the alkali metal chloride from the zinc carbonate precipitation step is electrolyzed in the electrolytic cell to form chlorine and alkali metal hydroxide.

9. The process of claim 8 in which the alkali metal hydroxide is converted to alkali metal carbonate for the zinc carbonate precipitation step.

10. The process of claim 1 in which the zinc containing material is a complex zinc sulfide ore.

11. The process of claim 10 in which the ore contains sulfides of lead and silver.

12. The process of claim 1 in which the stripping and electrolysis is conducted with alkali metal chloride solution having a molality of about 1–2.

13. The process of claim 1 in which the ferrous chloride from which zinc chloride is extracted is converted to ferric chloride for leaching by chlorine from the electrolytic cell.

14. The process of claim 1 in which lead is recovered from the crystallized lead chloride by fused bath electrolysis and the chlorine given off at the anode reused to convert ferrous chloride to ferric chloride for leaching.

15. The process of claim 1 in which the alkali metal compounds are sodium compounds.

16. The process of claim 1 in which the concentration of the ferrous ion for chlorination leaching is at least about 1 mole per liter to maintain solubility of lead chloride.

17. A process for recovering metal values from zinc containing material including lead, copper, silver, iron and trace metals comprising the following steps:

a. converting the metals in the material to chlorides including ferric chloride by wet chlorination with ferric chloride leaching or dry chlorination with chlorine gas to form a leach solution of metal chlorides,
b. removing lead chlorine from the leach solution by crystallization and recovering lead from the recovered lead chloride,
c. removing copper, silver and trace metals from the leach solution by cementation,
d. reducing the ferric iron in the leach solution substantially all to ferrous iron,
e. separating zinc chloride and ferrous chloride in the metal depleted leach solution by contacting the leach solution with an extraction agent selective for zinc chloride selected from the group consisting of lower alkylphosphates and tertiary amines,
f. stripping zinc chloride from the extraction agent with alkali metal chloride solution,
g. precipitating zinc from the stripping solution with alkali metal carbonate to form alkali metal chloride and zinc carbonate from which latter zinc is recovered,
h. sending the alkali metal chloride from the zinc precipitation step to an electrolytic cell,
i. electrolyzing part of the alkali metal chloride in the electrolytic cell to form chlorine at the anode and alkali metal hydroxide,
j. carbonating the alkali hydroxide from step (i) to form alkali metal carbonate which is sent to the zinc carbonation step, and
k. returning the remainder of the alkali metal chloride to stripping step (f) after it has been depleted in the cell of chlorine ions picked up in the stripping.

18. The process of claim 17 in which ferrous chloride from step (e) is oxidized to ferric chloride for leaching in step (a).

19. The process of claim 18 in which the oxidation is performed with chlorine gas from the electrolysis.

20. The process of claim 17 in which the alkali metal compounds are sodium compounds.

21. The process of claim 17 in which metallic iron is used in steps (c) and (d) to cement out lead, silver, and other trace metals and to reduce ferric iron in the leach solution to ferrous iron.

22. The process of claim 17 in which the extraction agent is an amine and loading is performed at a basic pH.

23. The process of claim 17 in which the stripping of step (f) and the electrolysis (i) are performed with sodium chloride having a molality of about 1–2 moles per liter.

24. The process of claim 17 in which lead is recovered from lead chloride by fused bath electrolysis and the chlorine formed is used to oxidize ferrous chloride to ferric chloride for leaching step (a).

25. The process of claim 17 in which the zinc containing material is a complex zinc sulfide ore.

26. In the process for treatment of materials containing zinc and other metals including lead, copper, silver, iron and trace metals, the process including conversion of the metals to chlorides including ferric chloride either by wet chlorination with ferric chloride leaching or dry chlorination to form a leach solution followed by recovery of lead from the leach solution by crystallizing the lead as lead chloride, removal of copper, silver, and trace metals from the leach solution, reducing substantially all of the ferric chloride in the leach solution to ferrous chloride, ultimately precipitating zinc from the leach solution as zinc carbonate with alkali metal carbonate and electrolyzing alkali metal chloride formed by the precipitation of zinc carbonate with alkali metal carbonate to produce chlorine gas which is returned to leaching and alkali metal hydroxide which is converted to alkali metal carbonate and the latter cycled to the zinc carbonate precipitation step, the improvement which comprises: recovering zinc chloride from the lead, copper, silver and trace metal depleted leach solution prior to zinc carbonate precipitation with an extraction agent selective for zinc chloride dissolved in an immiscible organic solvent, and stripping the zinc chloride from the extraction with an alkali metal chloride stripping solution from the electrolytic cell through which the alkali metal chloride solution from the zinc carbonate precipitation step is passed for removal from it of excess chlorine ion picked up in the stripping.

27. The process of claim 26 in which the alkali metal compounds are sodium compounds.

* * * * *